US011420353B2

(12) United States Patent
Malliaros et al.

(10) Patent No.: US 11,420,353 B2
(45) Date of Patent: Aug. 23, 2022

(54) BLADE ASSEMBLY ATTACHMENT DEVICE AND RAZOR ASSEMBLY

(71) Applicant: Bic Violex S.A., Anoixi (GR)

(72) Inventors: Ioannis Malliaros, Athens (GR); Vasileios Ntavos, Athens (GR)

(73) Assignee: BIC Violex Single Member S.A., Anoixi (GR)

( * ) Notice: Subject to any disclaimer, the term of this patent is extended or adjusted under 35 U.S.C. 154(b) by 32 days.

(21) Appl. No.: 17/252,237

(22) PCT Filed: Aug. 13, 2019

(86) PCT No.: PCT/EP2019/071671

§ 371 (c)(1),
(2) Date: Dec. 14, 2020

(87) PCT Pub. No.: WO2020/043477

PCT Pub. Date: Mar. 5, 2020

(65) Prior Publication Data

US 2021/0187770 A1 Jun. 24, 2021

(30) Foreign Application Priority Data

Aug. 31, 2018 (EP) ..... 18192022

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01)

(58) Field of Classification Search
USPC ..... 30/532
See application file for complete search history.

(56) References Cited

U.S. PATENT DOCUMENTS 3,363,312 A * 1/1968 Fayed ..... B26B 21/26 30/41.7
4,617,736 A * 10/1986 McCrary ..... B26B 5/006 30/169
4,658,505 A * 4/1987 Williams ..... B26B 21/521 30/47

(Continued)

FOREIGN PATENT DOCUMENTS

CH 218155 A 11/1941
DE 344677 C 11/1921

(Continued)

OTHER PUBLICATIONS

International Search Report and Written Opinion dated Nov. 5, 2019 in counterpart International Patent Application No. PCT/EP2019/071671 (13 pages, in English).

*Primary Examiner* — Hwei-Siu C Payer
(74) *Attorney, Agent, or Firm* — Bookoff McAndrews, PLLC

(57) ABSTRACT

This application relates to an elastic pin for selectively attaching a blade assembly to a razor handle may be provided. The elastic pin may comprise a pair of prongs attached at a proximal end, extending to a distal end. The pair of prongs may have an angle β therebetween. A respective distal end of each prong of the pair of prongs may form a convex head. The convex heads may be configured to define a substantially spherical envelope at the distal end of the elastic pin.

20 Claims, 2 Drawing Sheets

(56) References Cited

U.S. PATENT DOCUMENTS

| | | | | |
|---|---|---|---|---|
| 4,926,553 | A | 5/1990 | Miskin et al. | |
| 9,849,599 | B2 | 12/2017 | Gers-Barlag et al. | |
| 9,873,206 | B2 * | 1/2018 | Gulledge | B26B 21/521 |
| 2014/0237828 | A1 | 8/2014 | Bucco | |
| 2015/0273708 | A1 | 10/2015 | Haba | |
| 2016/0250764 | A1 | 9/2016 | Hashimoto | |
| 2017/0136638 | A1 * | 5/2017 | Hage | B26B 21/4068 |
| 2021/0187770 | A1 * | 6/2021 | Malliaros | B26B 21/521 |

FOREIGN PATENT DOCUMENTS

| | | | |
|---|---|---|---|
| FR | 784362 | A | 7/1935 |
| WO | 2008/077875 | A1 | 7/2008 |

* cited by examiner

BLADE ASSEMBLY ATTACHMENT DEVICE AND RAZOR ASSEMBLY

CROSS REFERENCES TO OTHER APPLICATIONS

This application is a National Stage Application of International Application No. PCT/EP2019/071671, filed on 13 Aug. 2019, now published as WO/2020/043477 and which claims priority to European Patent Application EP18192022.4 filed on 31 Aug. 2018, entitled "BLADE ASSEMBLY ATTACHMENT DEVICE AND RAZOR ASSEMBLY".

FIELD

The present description relates to attachment devices for selectively attaching a blade assembly to a razor handle. More specifically to an elastic pin for selectively attaching a blade assembly to a razor handle and a razor assembly comprising a handle, blade assembly, and the elastic pin which releasably connects the handle and blade assembly.

BACKGROUND

A common problem with razor assemblies having interchangeable blade assemblies is a lack of freedom of movement of the razor head. This is typically because of the attachment mechanism in the handle. This limitation in the freedom of movement can prevent the shaving head from adapting to the contours of human skin during a shaving operation, thereby increasing the risk of cuts. To address this issue, blade assemblies having interchangeable blade assemblies while also being rotatable about an axis have been developed.

For Example, US 2016/250764 discloses a razor with a detachable blade cartridge that allows a blade cartridge to be detachably coupled to a holder where the blades within the housing are rotatable relative to the connecting portion of the blade assembly.

Another example is US 2015/273708 A1 which discloses a blade assembly having a pivoting mechanism provided at the top portion of the holder and a supported portion provided at the razor head.

US 2014/237828 and U.S. Pat. No. 9,849,599 B2 disclose a razor assembly having a pivot sphere at the end of the handle upon which the blade assembly is rotatably mounted.

FR784362A discloses safety razors having a thin blade between a guard or support and a cover plate, the latter being provided with a threaded rod which passes through the blade and the guard and is screwed into the end of a handle.

DE344677C describes a safety razor with a ball and socket joint, in which the circling ball is partially enclosed and held by two opposing, resilient, cup-shaped, buttocks-like jaws, and the ball joint is detected by the clamping jaws themselves.

U.S. Pat. No. 4,926,553A discloses arcuate blade type razors with an offset adjustable razor head, for trimming and shaping beards, mustaches, sideburns and the like.

SUMMARY

The blade assembly may be interchangeable, in particular, when a blade or blades of the blade assembly have been blunted. The razor assembly may be specifically adapted for shaving facial, head, and/or body hair. To address the problems of providing a razor assembly adapted to have an interchangeable blade assembly while also maximizing the freedom of movement of the blade assembly while in use, an elastic pin for selectively attaching a blade assembly to a razor handle and a razor blade assembly having the elastic pin to operatively connect the handle and blade assembly are provided.

In particular, an elastic pin for selectively attaching a blade assembly to a razor handle may be provided. The elastic pin may comprise a pair of prongs attached at a proximal end, extending to a distal end. The pair of prongs may have an angle β therebetween. The distal end of the elastic pin may form a convex head. In particular, a respective distal end of each prong of the pair of prongs may form a convex head portion. The convex head, in particular, the convex head portions may be configured to define a substantially spherical envelope at the distal end of the elastic pin.

The configuration of the prongs of the elastic pin allows it to be releasably connectable with a razor handle. Further, the convex heads permit a shaving blade assembly to rotate about any axis relative to the elastic pin and consequently relative to the handle.

In aspects, the elastic pin may further include a raised portion disposed on at least one prong of the pair of prongs.

The raised portion secures the elastic pin to the housing as well as allows a user to manipulate the positioning of the prongs of the elastic pin.

In aspects, the elastic pin may be configured to adopt a rest position that may have a rest angle β between the prongs of the pair of prongs in a range of $4 \leq \beta \leq 8$ degrees when the elastic pin is in the rest position.

In aspects, the elastic pin may be configured to elastically deform such that the pair of prongs may be moved closer together to form an angle less than the rest angle β between the prongs.

This elastic deformation allows the elastic pin to facilitate the selective attachment of the blade assembly.

In aspects, when the elastic pin is in an engaged position, the angle β between the prongs may be in a range of $4 \leq \beta \leq 8$ degrees.

As aforementioned, when the elastic pin is properly placed into the cavity, the elastic pin remains in a deformed and constrained state. This is the engaged position, which helps securely fit the elastic pin within the cavity.

In aspects, the angle β between the prongs when the elastic pin in is in the engaged position may be less than the angle between the prongs when the elastic pin is in the rest position.

As aforementioned, this deformation, or difference in the angle β between the prongs in the rest and engaged positions, causes the prongs to apply a force against the interior surface of the cavity of the housing which helps securely fit the elastic pin within the cavity.

In other aspects, a razor assembly may comprise a handle having a connecting portion at a distal end; an elastic pin according to any one of the abovementioned aspects, the elastic pin may be configured to interconnect with the connecting portion of the handle, and a blade assembly that may have a housing with a receiving portion that is configured to releasably connect with the elastic pin.

This configuration of the razor assembly allows the blade assembly to be releasably connectable with a razor handle, without the need to use an interconnecting member, thus allowing the user to easily replace the blade assembly. Additionally, due to the freedom of rotation of the blade assembly relative to the handle, this configuration facilitates an improved shaving experience because the blade assembly can adapt to the contours of the skin during shaving operation.

In aspects, in the razor assembly, the raised portion of the elastic pin may be disposed at least partially in a window that may be formed in the connecting portion.

The window of the housing secures the raised portion of the elastic pin therein as well as provides access to the elastic pin so that a user can manipulate the positioning of the prongs.

In aspects, the connecting portion may include a V-shaped cavity that is configured to receive a pair of prongs at the proximal end of the elastic pin.

The V-shaped cavity guides the prongs such that the heads on the distal end thereof form a substantially or entirely spherical envelope.

In aspects, an exterior surface of the distal end of the handle may form a spherical contact surface.

This spherical contact surface is adapted to facilitate the freedom of rotational movement of the blade assembly relative to the elastic pin and/or handle.

In aspects, the receiving portion of the blade assembly may be configured to define a substantially spherical envelope configured to substantially surround the convex head portions of the distal portion of the elastic pin.

This spherical envelope is adapted to surround the spherical envelope formed by the heads of the elastic pin. This configuration facilitates the freedom of rotational movement of the blade assembly relative to the elastic pin and/or handle which allows the blade assembly to adapt to the contours of skin thereby resulting in an improved shaving experience for the user.

In aspects, the razor assembly may further include a spring arranged between the handle and the blade assembly; the spring may be configured to urge the housing of the blade assembly away from the distal end of the handle.

The spring is configured to align the blade assembly and the handle by urging the blade assembly away from the distal end of the handle, thus maintaining the blade assembly in an aligned position relative to the handle. The spring is also configured to apply a force on the blade assembly thereby transferring a pressure onto the surface on the skin of a user during a shaving operation. This pressure results in a more uniform and close shave.

In aspects, the spring may be a coil spring, more specifically; the spring may be a spherically shaped coil spring.

A spherical spring allows for an even distribution of the applied forces on the blade assembly.

In aspects, the spring may be configured to align the housing relative to the handle.

In aspects, the elastic pin may be configured to adopt a close fit within the connecting portion of the blade assembly.

This close fit allows for the blade assembly to remain secured to the elastic pin during a shaving operation.

In aspects, the angle $\beta$ between the prongs of the pair of prongs when the elastic pin is in an engaged position may be lower than the angle $\beta$ in the rest position.

The angle $\beta$ between the prongs when the prongs are in the rest position may be configured to be greater than the angle $\alpha$ of the cavity of the handle. Thus, when placed into the cavity, the elastic pin remains in a deformed state which applies a force against the interior surface of the cavity.

The above summary is not intended to describe each and every implementation of the concept. In particular, selected features of any illustrative embodiment within this disclosure may be incorporated into additional embodiments unless clearly stated to the contrary.

BRIEF DESCRIPTION OF THE DRAWINGS

The disclosure may be more completely understood in consideration of the following detailed description of aspects of the disclosure in connection with the accompanying drawings, in which.

Figure 1A:
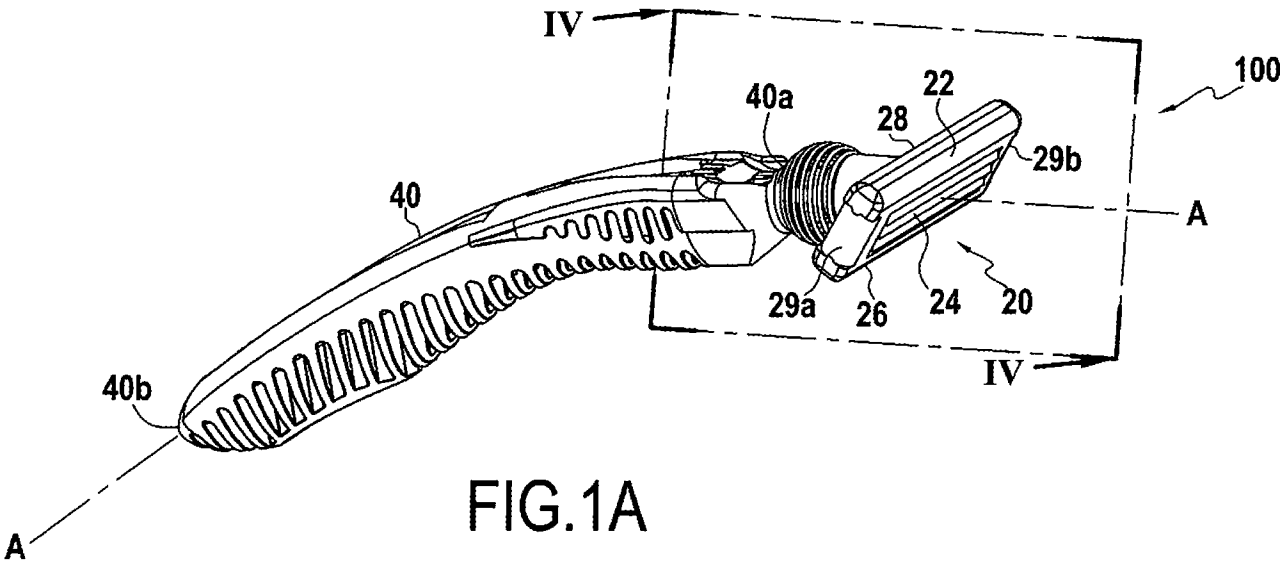
FIG. 1A is a perspective view of a razor assembly according to an aspect.

While aspects of the disclosure are amenable to various modifications and alternative forms, specifics thereof have been shown by way of example in the drawings and will be described in detail. It should be understood, however, that the intention is not to limit aspects of the disclosure to the particular embodiment described. On the contrary, the intention of this disclosure is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise. The use of the term "distal" is refers to a portion of the device that is furthest from the user and "proximal" refers to a portion of the device that is closest to the user.

The following detailed description should be read with reference to the drawings. The detailed description and the drawings, which are not necessarily to scale, depict illustrative aspects and are not intended to limit the scope of the invention. The illustrative aspects depicted are intended only as exemplary.

Figure 1B:
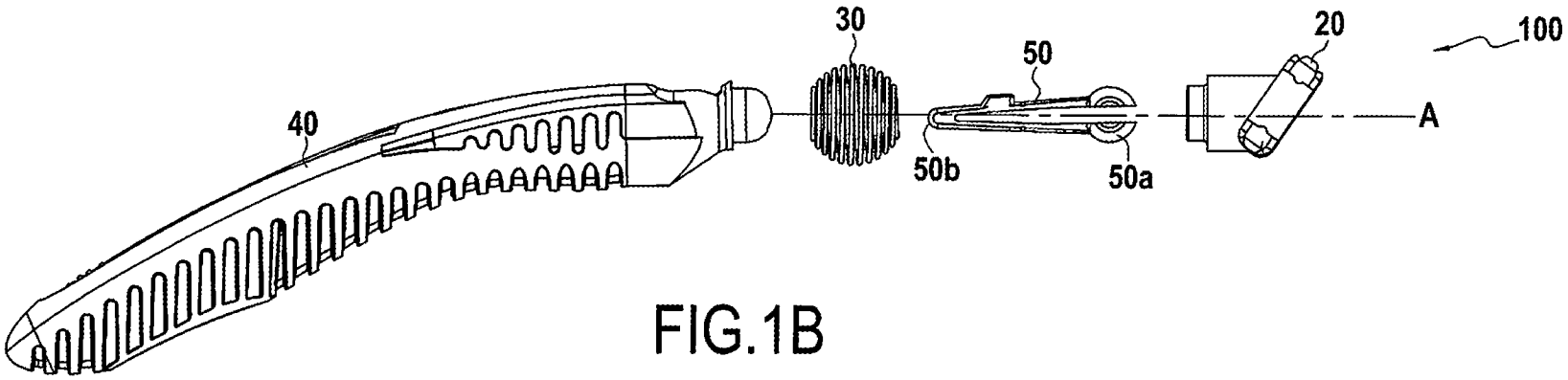
FIG. 1B is an exploded perspective view of the razor assembly according to an aspect.

FIGS. 1A and 1B show a perspective view of a razor assembly 100 having a blade assembly 20, spring 30, handle 40, and elastic pin 50. The blade assembly 20 may have a housing 22 that may be hollow and generally form a rectangular parallelepiped; however, the housing 22 may be any other suitable shape.

Secured within the housing 22 is at least one blade 24. In this embodiment, a plurality of blades 24 are shown, however, it is contemplated that the blade assembly 20 may have any number of blades 24. Additionally, the blades 24 that are shown are elongate in shape; however, it is contemplated that the blades 24 may be formed into any other suitable shape.

The blade assembly 20 may also include a guard bar 26, a cap 28, and a pair of retainers 29*a*, 29*b*. Further examples of the retainers may be found in U.S. Pat. No. 9,539,734 (B1). The retainers 29*a*, 29*b* are adapted to retain the position of the blades 24 within the housing 22. The retainers 29*a*, 29*b* may extend along a pair of side edges of the housing 22 and are spaced apart and positioned on opposite sides of the housing 22. The retainers 29*a*, 29*b* may be either integral with the housing 22 or a separate component assembled with the housing 22.

Figure 4:
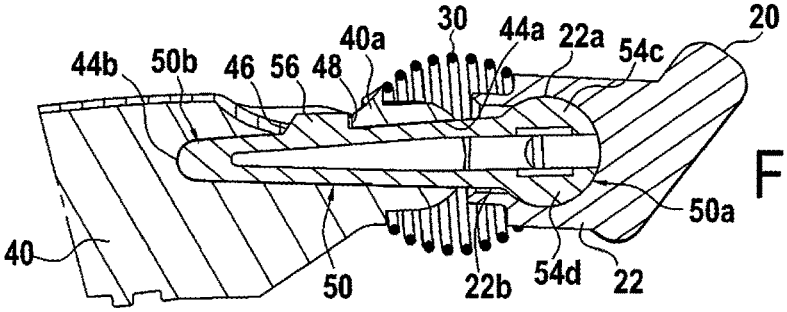

The housing 22 may include a receiving portion 22*a*. The receiving portion 22*a* may have an opening 22*b* adapted to receive the elastic pin 50. The receiving portion 22*a* may be a cavity. This cavity may be formed as to substantially or fully define a spherical envelop in the housing 22, as shown in FIG. 4.

The razor assembly 100 further includes an elongated handle 40 extending along a vertical central axis A-A. The handle 40 has a distal end 40*a* and a proximal end 40*b*. The handle 40 may be shaped to adapt to the natural contours of a hand. The distal end 40*a* of the handle 40 may have a connecting portion 42 that is adapted to connect to the elastic pin 50 of the blade assembly 20, which can be seen in FIGS. 2 and 4.

The razor assembly 100 further includes a spring 30 that is positioned around the distal end 40*a* of the handle 40. The spring 30 may be a coil spring. The spring 30 may be formed in a spherical shape. A spherical spring allows for an even distribution of the applied forces on the blade assembly when the blade assembly is pivoted in any direction. Further, a spherical coil spring facilitates an efficient return of the blade assembly into its initial, rest position. For example, in comparison with a cylindrical shaped spring, the end of the spherical coil spring where the spring attaches the blade assembly is narrower than the middle of the spring and thus can provide a more efficient return of the blade assembly into its rest position. Lastly, a spherical spring signals to a consumer its function, for example, a razor assembly having a blade assembly that can pivot in all directions. The spring 30 may be made of any suitable material, for example a polymer or metal.

Figure 2:
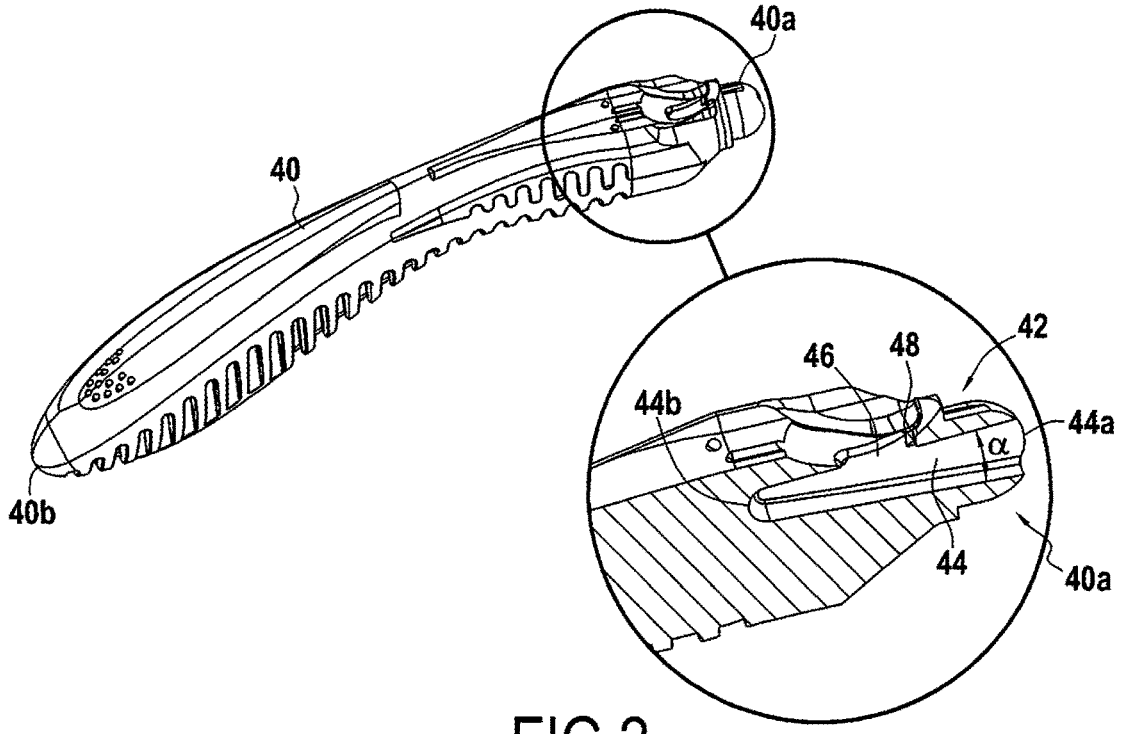
FIG. 2 is a perspective view of a handle of the razor assembly according to an aspect.

As can be seen in FIG. 2, the distal end 40*a* of the handle 40 has a connecting portion 42. As shown in the detail view of the connecting portion 42, which is a cross-section of the distal end 40*a* of the handle 40, the connecting portion 42 includes a cavity 44 formed within the handle 40. The cavity 44 has an opening 44*a* adapted to receive the elastic pin 50. The cavity 44 may be V-shaped or in any other suitable shape complementary to the elastic pin 50 in order for the elastic pin 50 to adopt a close fit position within the cavity 44 of the connecting portion 42 of the handle 40.

The connecting portion 42 may further include a window 46 that is adapted to provide a user with access to the elastic pin 50 when the elastic pin 50 is disposed inside the cavity 44. The window 46 may extend into the handle 40 forming a wall 48. The wall 48 may extend between the exterior of the handle 40 and the cavity 44. This wall 48 may be substantially perpendicular to the longitudinal axis A-A of the handle 40. The wall 48 may be flat. The wall 48 may be curved. The wall 48 may be at an angle relative to the longitudinal axis A-A of the handle 40 and form an incline between the cavity 44 and the exterior surface of the handle 40.

The cavity 44 may further include a bended region 44*b* disposed at an opposing end of the opening 44*a* of the cavity 44. The bended region may have a radius of curvature within a range of 1-2 mm. In an example a radius of curvature of 1.5 mm may be foreseen. Additionally, the bended region 44*b* may form an angle $\alpha$. The cavity 44 may be formed such that it is tapered from the opening 44*a* to the bended region at the angle $\alpha$. The angle $\alpha$ formed by the cavity 44 may be within a range of $4 \leq \alpha \leq 8$ degrees, in examples $5 \leq \alpha \leq 7$. In an example, an angle $\alpha$ of 6 degrees may be foreseen.

The exterior surface of the distal end 40*a* of the handle 40 may be substantially or entirely spherical or hemi-spherical in shape. This shape may facilitate the relative rotational movement of the blade assembly 20 and the handle 40.

Figure 3A:
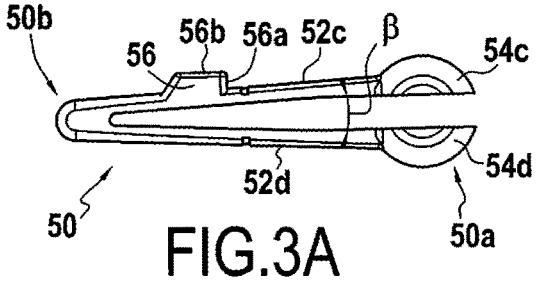
FIG. 3A is a side view of an elastic pin of the razor assembly according to an aspect when in a rest position.
Figure 3B:
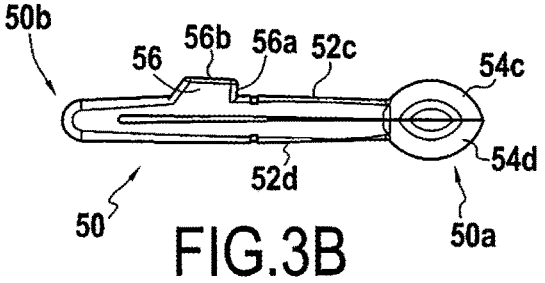
FIG. 3B is a side view of the elastic pin of the razor assembly according to an aspect when in a closed position.
Figure 3C:
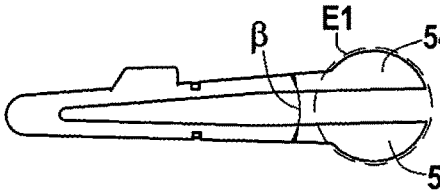
FIG. 3C is a side view of the elastic pin of the razor assembly according to an aspect when in an engaged position and FIG. 4 is a cross-section of the razor assembly according to an aspect.

FIGS. 3A-3C are side views of the elastic pin 50 of the razor assembly 100 in three different states or positions. FIG. 3A shows the elastic pin 50 in a released or rest position. The elastic pin 50 has a distal end 50*a* and a proximal end 50*b*. The proximal end 50*b* may be formed as juncture for a pair of prongs 52*c*, 52*d*. This juncture may be a section where the prongs 52*c*, 52*d* are joined; however, this juncture may also be a bended region from which the prongs 52*c*, 52*d* extend therefrom.

The prongs 52*c*, 52*d* may form an angle $\beta$ therebetween. Angle $\beta$ may be within a range $4 \leq \beta \leq 8$ degrees. when the elastic pin 50 is in a rest position. In an example, an angle $\beta$ of 6 degrees may be foreseen. Each of the prongs 52*c*, 52*d* may include a respective head 54*c*, 54*d* disposed on the distal end 50*a* of the elastic pin 50. Each of the heads 54*c*, 54*d* may have a convex shape. The heads 54*c*, 54*d* may have substantially the same dimensions.

As can be seen in FIG. 3B, the elastic pin 50 is in a closed position. In this position, the heads 54*c*, 54*d* of the prongs 52*c*, 52*d* are in contact each other. This closed position is achieved during attachment/detachment operation of the cartridge, i.e. the housing 22 to the handle 40 via the elastic pin 50. In this closed position, the angle $\beta$ between the prongs is clearly smaller than in the rest or in the engaged positions.

As can be seen in FIG. 3C, the elastic pin 50 is in an engaged position. For example, the elastic pin 50 may be configured to be in the engaged position when it is assembled into the receiving portion 22*a* of the housing 22. Due to the convex shape of the heads 54*c*, 54*d* of the prongs 52*c*, 52*d*, when the elastic pin 50 is in this engaged position, the heads 54*c*, 54*d* of the prongs form a substantially or entirely spherical envelope E1. In other words, the heads 54*c*, 54*d* define a spherical envelope when the prongs 52*c*, 52*d* are constrained to form an angle $\beta$ therebetween that is equal to the angle $\beta$ when the elastic pin 50 is in the rest position. In this configuration, the lifetime of the elastic pin 50 is extended since the pin is not under further tension when in the engaged position. However, in further examples, the angle $\beta$ between the prongs 52*c*, 52*d* when they are constrained, i.e. in the engaged position may be smaller than the angle $\beta$ when in the rest position. This configuration ensures that the elastic pin 50 maintains a close fit within the cavity 44 of the handle 40.

What is intended by "envelope" is a curve that is tangential to each one of a family of curves in a plane or, in three dimensions, a surface that is tangent to each one of a family of surfaces. The shape of the heads 54*c*, 54*d* of the prongs 52*c*, 52*d* in this configuration facilitate freedom of relative movement between the elastic pin 50 and the blade assembly 20. Angle $\beta$ may be within a range of $4 \leq \beta \leq 8$ degrees, when the elastic pin 50 is in the engaged position. In an example, an angle $\beta$ of 6 degrees may be foreseen.

The elastic pin 50 may further include a raised portion 56 disposed on at least one prong 52*c*, 52*d*. The raised portion 56 is configured to be disposed at least partially in the window 46 of the handle 40. The raised portion 56 may include at least two facets. A first facet 56*a*, is adapted to engage the wall 48 of the handle 40. A second facet 56*b* may be adapted to be engaged by a razor blade user.

Referring to FIGS. 1B and 4, to assemble the components of the razor assembly 100, a user may first obtain the handle 40. The spring 30 may then be positioned over the distal end 40*a* of the handle 40. Thereafter, the user may then insert the proximal end 50*b* of the elastic pin 50 through the spring 30 and into the opening 44*a* of the handle 40. The elastic pin 50 may be in the closed position during this process. Once the proximal end 50*b* of the elastic pin 50 reaches the bended region 44*b* of the cavity 44 of the handle 40, the elastic pin 50 will transition into the engaged position. This is possible when the raised portion 56 of the elastic pin 50 is positioned into the window 46 of the handle 40.

In one example, the angle β between the prongs 52*c*, 52*d* when the prongs 52*c*, 52*d* are in the rest position may be configured to be equal to or greater than the angle β between the prongs 52*c*, 52*d* when the prongs 52*c*, 52*d* are in the engaged position. Therefore, the angle α of the cavity is less than or equal to the angle β between the prongs 52*c*, 52*d* when the prongs 52*c*, 52*d* are in the rest position so that the when the elastic pin 50 is placed into the cavity 44, the elastic pin 50 is held in a deformed and constrained state. This deformation causes the prongs 52*c*, 52*d* to apply a force against the interior surface of the cavity 44 maintaining a close fit within the cavity 44. The force exerted by the prongs 52*c*, 52*d* helps securely fit the elastic pin 50 within the cavity 44 and therefore ensure secure and safe attachment of a razor handle 40 to the blade assembly 20.

If a user desires to attach the blade assembly 20, the user may apply a force on the raised portion 56 of the elastic pin 50, which is accessible through the window 46 formed in the handle 40. This force transitions the elastic pin from the engaged position into the closed position by elastically deforming the pair of prongs 52*c*, 52*d* closer together.

When in this position, the heads 54*c*, 54*d* of the elastic pin 50 are in contact with each other and can be inserted in to the receiving portion 22*a* formed in the housing 22 of the blade assembly 20. Once the heads 54*c*, 54*d* are positioned within the receiving portion 22*a* of the housing 22, the user can release the raised portion 56 of the elastic pin 50 and allow the elastic pin 50 to transition into the engaged position. When in this position, the raised portion 56 of the elastic pin 50 is disposed in the window 46 of the housing 40.

In order to prevent unwanted dislodgement of the blade assembly from the elastic pin 50 or unwanted dislodgement of the elastic pin 50 form the handle 40, the first facet 56*a* of the raised portion 56 is adapted to contact the wall 48 of the window 46. In other words, the wall 48 of the window 46 prevents the displacement of the elastic pin 50 along the longitudinal axis A-A. Further, the housing 22 is secured to the elastic pin 50 due to the nested spherical envelopes E1. In particular, when the elastic pin 50 is in the engaged position and the prongs 52*c*, 52*d* are disposed at an angle β, the heads 54*c*, 54*d* of the elastic pin 50 are secured within the receiving portion 22*a* of the housing 22.

If a user wishes to detach the blade assembly 20 from the elastic pin 50, the user can apply a force on the raised portion 56 to move the elastic pin into the closed position and remove the elastic pin 50 from the housing 22.

Now, the rotational operation of the razor assembly 100 will be discussed. In operation, the blade assembly 20 is permitted to rotate about any rotational axis relative to the elastic pin 50. This is because of the shape of the concentric spherical envelopes. Furthermore, the spring 30 urges the blade assembly 20 away from the distal end 40*a* of the handle 40. This spring force, maintains the blade assembly 20 in an aligned position relative to the handle 40. It also adds a reactive force when the housing 22 is rotated from its initial position. This reactive force helps apply an even pressure on the skin when a user is performing a saving operation.

This razor assembly 100 reduces the number of components needed in interchangeable assemblies while also promoting a maximum rotation as to allow the blade assembly 20 to adapt to the contours of human skin. This configuration improves the quality of the shaving and reduces the risk of a user being cut during a shaving operation.

Although the described embodiments were provided as different exemplary embodiments, it is envisioned that these embodiments are combinable or, when not conflicting, the features recited in the described embodiments may be interchangeable.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A razor handle comprising a connecting portion at a distal end, an elastic pin for selectively attaching a blade assembly to the razor handle, the elastic pin comprising:

a pair of prongs attached to each other at a proximal end of the elastic pin and extending to a distal end of the elastic pin, and having an angle therebetween, wherein a respective distal end of each prong of the pair of prongs form a convex head, wherein the convex heads are configured to define a substantially spherical envelope at the distal end of the elastic pin, wherein the elastic pin further includes a raised portion disposed on at least one prong of the pair of prongs, the raised portion being disposed at least partially in a window formed in the connecting portion of the razor handle.

2. The razor handle of claim 1, wherein the elastic pin is configured to adopt a rest position having a rest angle between the prongs of the pair of prongs in a range of $4 \leq \beta \leq 8$ degrees.

3. The razor handle of claim 2, wherein an angle between the prongs of the pair of prongs when the elastic pin is in an engaged position is equal to the rest angle in the rest position, the engaged position being a position when the elastic pin attaches the razor handle to the blade assembly.

4. The razor handle of claim 2, wherein an angle between the prongs of the pair of prongs when the elastic pin is in an engaged position is smaller than the rest angle in the rest position, the engaged position being a position when the elastic pin attaches the razor handle to the blade assembly.

5. The razor handle of claim 1, wherein the elastic pin is configured to elastically deform such that the pair of prongs can be moved closer together so as to form an angle that is smaller than a rest angle between the pair of prongs.

6. A razor assembly, comprising:

the razor handle according to claim 1, and the blade assembly, wherein the blade assembly has a housing with a receiving portion that is configured to releasably connect with the elastic pin.

7. The razor assembly of claim 6, wherein the connecting portion includes a V-shaped cavity that is configured to receive the pair of prongs at the proximal end of the elastic pin.

8. The razor assembly of claim 6, wherein an exterior surface of the distal end of the handle forms a spherical contact surface.

9. The razor assembly of claim 6, wherein the receiving portion of the blade assembly is configured to define a substantially spherical envelope configured to substantially surround the convex heads of the distal end of the elastic pin.

10. The razor assembly of claim 6, further including a spring arranged between the handle and the blade assembly, the spring being configured to urge the housing of the blade assembly away from the distal end of the handle.

11. The razor assembly according to claim 10, wherein the spring is a coil spring.

12. The razor assembly of claim 11, wherein the spring is in the shape of a spherically shaped coil spring.

13. The razor assembly according to claim 10, wherein the spring is configured to align the housing relative to the razor handle.

14. The razor handle of claim 1, wherein the elastic pin is configured to adopt a close fit within the connecting portion of the razor handle.

15. An elastic pin configured to selectively attach a razor blade assembly to a razor handle, the elastic pin comprising:

a pair of prongs attached to each other at a proximal end of the elastic pin and extending to a distal end of the elastic pin, and having an angle therebetween, wherein a respective distal end of each prong of the pair of prongs form a convex head, wherein the convex heads are configured to define a substantially spherical envelope at the distal end of the elastic pin, and a raised portion disposed on at least one prong of the pair of prongs, the raised portion configured to be at least partially disposed in a window formed in a connecting portion of the razor handle when the elastic pin is attached to the razor handle.

16. The elastic pin of claim 15, wherein a rest angle between the prongs of the pair of prongs is in a range of $4 \leq \beta \leq 8$ degrees.

17. A razor assembly, comprising:

a razor handle having a connecting portion at a distal end, a blade assembly, and an elastic pin for selectively attaching the blade assembly to the razor handle, the elastic pin comprising:

a pair of prongs attached to each other at a proximal end of the elastic pin and extending to a distal end of the elastic pin, and having an angle therebetween, wherein a respective distal end of each prong of the pair of prongs form a convex head, wherein the convex heads are configured to define a rounded envelope at the distal end of the elastic pin, and a raised portion disposed on at least one prong of the pair of prongs, the raised portion being disposed at least partially in a window formed in the connecting portion of the razor handle.

18. The razor assembly of claim 17, wherein the blade assembly includes a receiving portion configured to define a rounded envelope configured to substantially surround the convex heads of the distal end of the elastic pin.

19. The razor assembly of claim 17, wherein the elastic pin is deformable between a first position and a second position, the first position being a closed position where the convex heads contact each other, and the second position being a position where the convex heads form a substantially spherical envelope.

20. The razor assembly of claim 17, further including a spring arranged between the handle and the blade assembly.

* * * * *